United States Patent [19]

Sketch

[11] Patent Number: 4,473,728

[45] Date of Patent: Sep. 25, 1984

[54] PUSH-PUSH ELECTRIC SWITCH

[75] Inventor: Harry F. Sketch, Warren, Mich.

[73] Assignee: Microdot Inc., Darien, Conn.

[21] Appl. No.: 530,481

[22] Filed: Sep. 9, 1983

[51] Int. Cl.[3] ..... H01H 5/18

[52] U.S. Cl. ..... 200/68.2; 200/153 J

[58] Field of Search ..... 200/68, 67 G, 153 J, 200/68.3

[56] References Cited

U.S. PATENT DOCUMENTS 3,038,981 6/1962 Larkin ..... 200/159 R X
3,213,229 10/1965 Carlson et al. ..... 200/68
3,596,022 7/1971 Gaber et al. ..... 200/68.1
4,095,070 6/1978 Simpson ..... 200/153 J
4,408,106 10/1983 Sorenson ..... 200/68

*Primary Examiner*—John W. Shepperd
*Assistant Examiner*—Renee Kidorf
*Attorney, Agent, or Firm*—Lyman R. Lyon

[57] ABSTRACT

An electric switch of the push-push type in which a first pushing actuation of a pushbutton assembly moves a switch rocker to a first switching position and a subsequent pushing actuation of the pushbutton plunger assembly moves the switch to an alternate switching position.

12 Claims, 9 Drawing Figures

PUSH-PUSH ELECTRIC SWITCH

BACKGROUND OF THE INVENTION

This invention relates to electric switches and more particularly to electric switches of the push-push type in which a first pushing actuation of a plunger assembly moves the switch to a first switching position and a subsequent pushing actuation of the plunger assembly moves the switch to an alternate switching position. Switches of this type are well known and are used in a variety of switching applications. Whereas prior art switches of this type have been generally satisfactory, each prior art design has embodied one or more disadvantages. Specifically, the prior art designs have either been prohibitively expensive to produce; or have exhibited relatively short useful lives due to structural failure of the commonly employed snap or toggle mechanism; or have been characterized by objectionably noisy operation; or have embodied design and operational features which severely limit their current carrying capacity, or provide relatively high current carrying capacity only at the sacrifice of useful life.

SUMMARY OF THE INVENTION

The present invention provides a switch of the push-push type which is simple and inexpensive to produce, provides a long useful life, is quiet in operation, and offers high current carrying capacity.

According to an important feature of the invention switch, a rocker is mounted in the switch housing for successive transport between its alternate switching positons in response to successive striking engagement by the leading edge of a push button plunger assembly and a combined rotary and translatory movement is imparted to the rocker as it is transported by the plunger between its alternate switching positions. Specifically, initial movement of the rocker toward a new switching position is substantially rotary to provide a quick, clean circuit break and the final movement of the rocker to the new switching position is substantially translatory so that the rocker contact wipes on the housing contact to avoid arcing and pitting and provide long switch life.

According to a further feature of the invention, trunnions provided at opposite sides of the rocker are supported by elongated curvilinear bearing surfaces including arcuate concave seat portions at each end and an intermediate convex curvilinear portion smoothly interconnecting the inboard ends of the concave seat portions. Spring means urge the trunnions into contact with the bearing surfaces and are vectored to augment movement of the trunnions along the convex intermediate bearing portions and into an arcuate seat portion so that the rocker moves quickly and quietly to its final switching position without the aid of noisy and failure prone snap action or toggle mechanisms.

In the disclosed embodiment of the invention, the transport of the rocker from one switching position to another is described initially by rotary movement of the trunnions in the respective bearing seat portions until a guide surface on the underside of the rocker engages a ramp surface provided on the housing beneath the rocker, whereafter further transport of the rocker is described by sliding movement of the trunnions out of the seat portions and along the intermediate convex bearing surfaces accompanied by sliding movement of the rocker guide surface on the ramp surface until a contact carried on an end of the rocker engages a fixed contact in the housing, whereafter the rocker lifts off of the ramp surface and further and final transport of the rocker is described by sliding movement of the trunnions along the intermediate convex bearing surfaces and into the other seat portions accompanied by sliding movement of the rocker contact along the fixed housing contact.

DETAILED DESCRIPTION OF THE PREFERRED EMBODIMENT OF THE INVENTION

Figure 1:
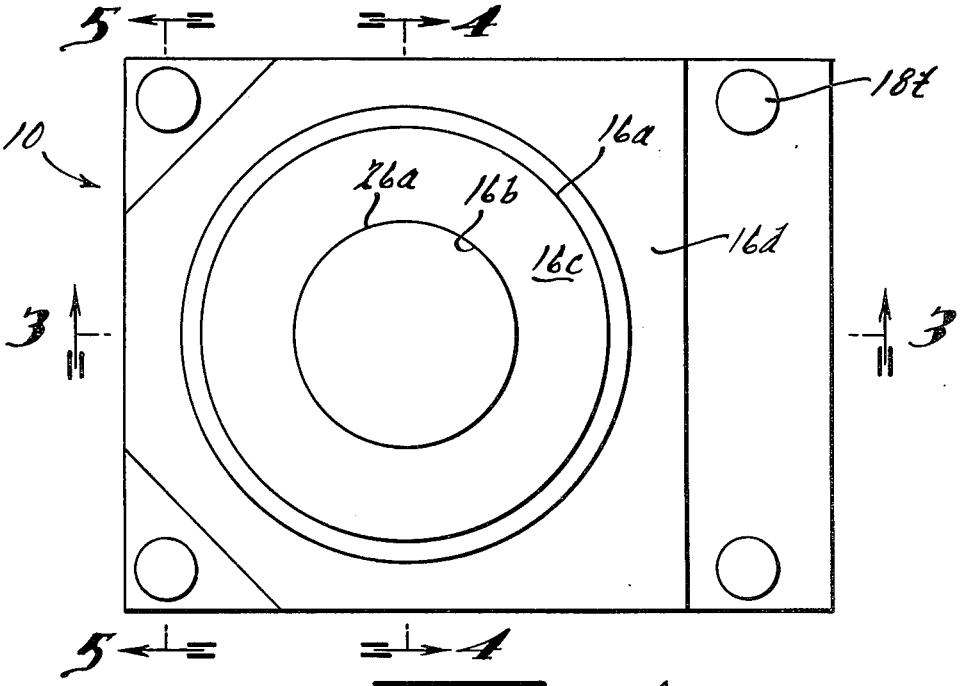
FIG. 1 is a top view of the invention electric switch.
Figure 2:
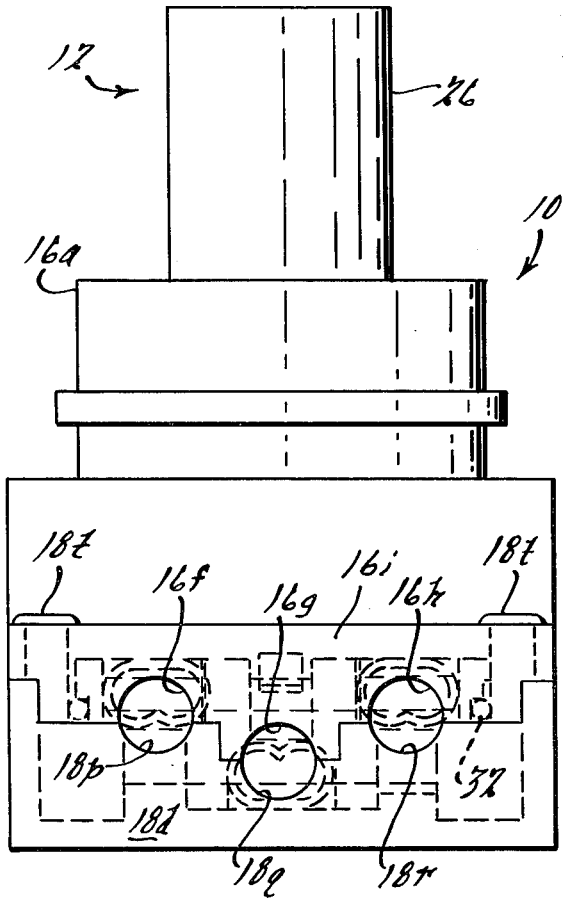
FIG. 2 is an end view of the invention switch.
Figure 4:
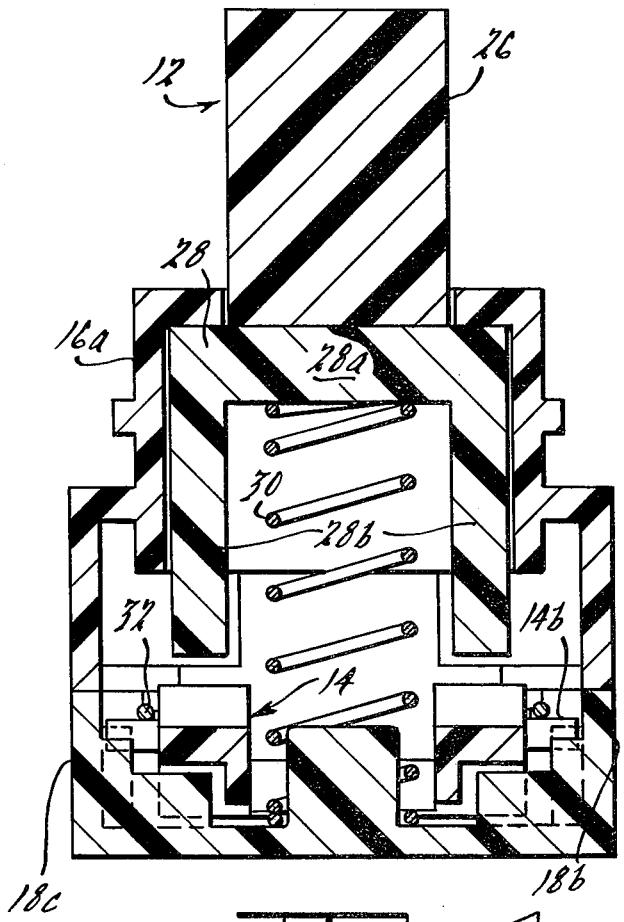
FIGS. 3, 4 and 5 are cross-sectional views taken on 3—3, 4—4 and 5—5 of FIG. 1.

The invention switch, broadly considered, includes a housing 10, an actuator assembly 12 and a rocker 14.

Housing 10 includes an upper housing 16 and a lower housing 18 together defining a housing chamber 20. Upper housing 16 includes a circular, hollow tower portion 16*a* defining a central circular opening 16*b* in its top wall 16*c*, and a hollow base portion 16*d*.

Lower housing 18 includes a bottom wall 18*a*, side walls 18*b* and 18*c*, a front end wall 18*d* and a rear end wall 18*e*. A post 18*f* is formed at each side of chamber 20 integral with respective side walls 18*b*, 18*c* and upstanding from bottom wall 18*a*. The upper end of each post is configured to form an elongated curvilinear upwardly facing bearing surface 18*g*. Each bearing surface 18*g* includes forward and rearward arcuate concave seat portions 18*h*, 18*i* at the forward and rearward ends of the bearing surface and an intermediate convex curvilinear portion 18*j* smoothly interconnecting the inboard ends of the arcuate concave seat portions 18*h*, 18*i*. A ramp structure 18*k* upstands from bottom wall 18*a* immediately inboard of and integral with each post 18*f*. Each ramp structure 18*k* defines ramp surfaces 18*l*, 18*m* which intersect on the center line of bearing surfaces 18*g*. A post 18*n* upstands from bottom wall 18*a* between ramp structures 18*k*. Front end wall 18*d* is scalloped at 18*p*, 18*q* and 18*r* and four stakes 18*s* upstand from the four corners of the bottom housing 18.

To assemble the upper and lower housings, stakes 18*s* are passed upwardly through holes 16*e* in the four corners of upper housing base portion 16*d* and the stakes are heated to form rivet heads 18*t*. Scallops 16*f*, 16*g* and 16*h* in upper housing front end wall 16*i* coact with lower housing scallops 18*p*, 18*q* and 18*r* to form circular openings for clamping passage of electrical wires 21, 22 and 24.

Actuator assembly 12 includes pushbutton 26, plunger 28 and return spring 30.

Pushbutton 26 is generally cylindrical and includes an upper portion 26*a* slidably received in central opening 16*d* of upper housing tower portion 16*a*, and a lower portion 26b positioned within tower portion 16a in the upper portion of housing chamber 20. Pushbutton 26 is guided in its reciprocal movement within tower portion 16a by the sliding coaction of upper pushbutton portion 26a in opening 16b and the sliding engagement of arcuate flange portions 26c on lower pushbutton portion 26b in arcuate grooves 16j formed in opposite sides of tower 16a. Lower pushbutton portion 26b is hollow and includes a downwardly opening slot 26d.

Plunger 28 is forked and includes an upper bridge portion 28a and spaced downwardly extending prong portions 28b. Plunger 28 is received at its upper end in slot 26d with the upper side edges of prong portions 28b guiding in slot 16k formed in the opposite side walls of tower 16a. The upper portions 16l of slot 16k embody parallel side walls which constrain plunger 28 to vertical movement relative to tower 16a while the lower portions 16m of slot 16k are splayed to allow plunger 28 limited pivotal movement relative to tower 16a.

Return spring 30 comprises a coil spring seated at its lower end on post 18k and seated at its upper end in the hollow lower end of pushbutton 26 with the top loop of the spring seated against arcuate shoulders 26e on pushbutton 26 and passing immediately beneath plunger bridge portion 28a.

Spring 30 thus serves the dual purpose of constantly maintaining the upper end of plunger 28 firmly seated against the upper end of pushbutton slots 26d and normally maintaining pushbutton 26 in its upper unactuated position by urging flanges 26c against arcuate shoulders 16n on tower 16a.

Rocker 14 is positioned in the lower portion of housing chamber 20 and includes a central opening 14a passing port 18n and coil spring 30. A pair of trunnions 14b extend laterally from opposite sides of a central portion of the rocker. Trunnions 14b are supported on bearing surfaces 18g and have a radius approximating that of the concave arcuate end portions 18b, 18i of bearing surfaces 18g. A pair of wires 32 of spring material are clamped at their ends between confronting surfaces of assembled upper and lower housings 16 and 18 and extend across chamber 20. Resiliently bowed intermediate portions 32a of wires 32 bear downwardly against generally oval-shaped guide portions 14c formed integrally with and inboard of trunnions 14b. Wires 32 thus continuously urge trunnions 14b downwardly against bearing surfaces 18g.

Rocker 14, considered end to end, has a substantially "W" configuration. The upper side of the rocker is configured to form a pair of interrupted, laterally extending notches 14d, 14e at opposite sides of a central apex 14f of the rocker and the underside of the rocker is configured to define a pair of interrupted, laterally extending guide surfaces 14g, 14h substantially underlying the bottoms of the respective notches 14d, 14e. Three laterally spaced fingers 14i, 14j, 14k project forwardly from the forward end of the rocker. Outboard fingers 14i, 14k include upwardly opening semi-circular slots 14l, 14m and central finger 14j includes a downwardly opening semi-circular slot 14n. A laterally extending contact pin 34 of circular bar stock is received in slots 14i, 14m and 14n.

Three terminals or contacts 36, 38 and 40 are positioned in the forward end of chamber 20 for switching coaction with contact pin 32. Terminals 36, 38 and 40 are respectively crimped to electric wires 21, 22 and 24. Central terminal 38 is a single terminal and provides a central lower contact for coaction with pin 32. Outboard terminal 36 is a single terminal and provides an outboard upper contact for coaction with pin 32. Outboard terminal 40 is a double or compound terminal and provides upper and lower contacts 40a, 40b for coaction with pin 32.

Figure 3:
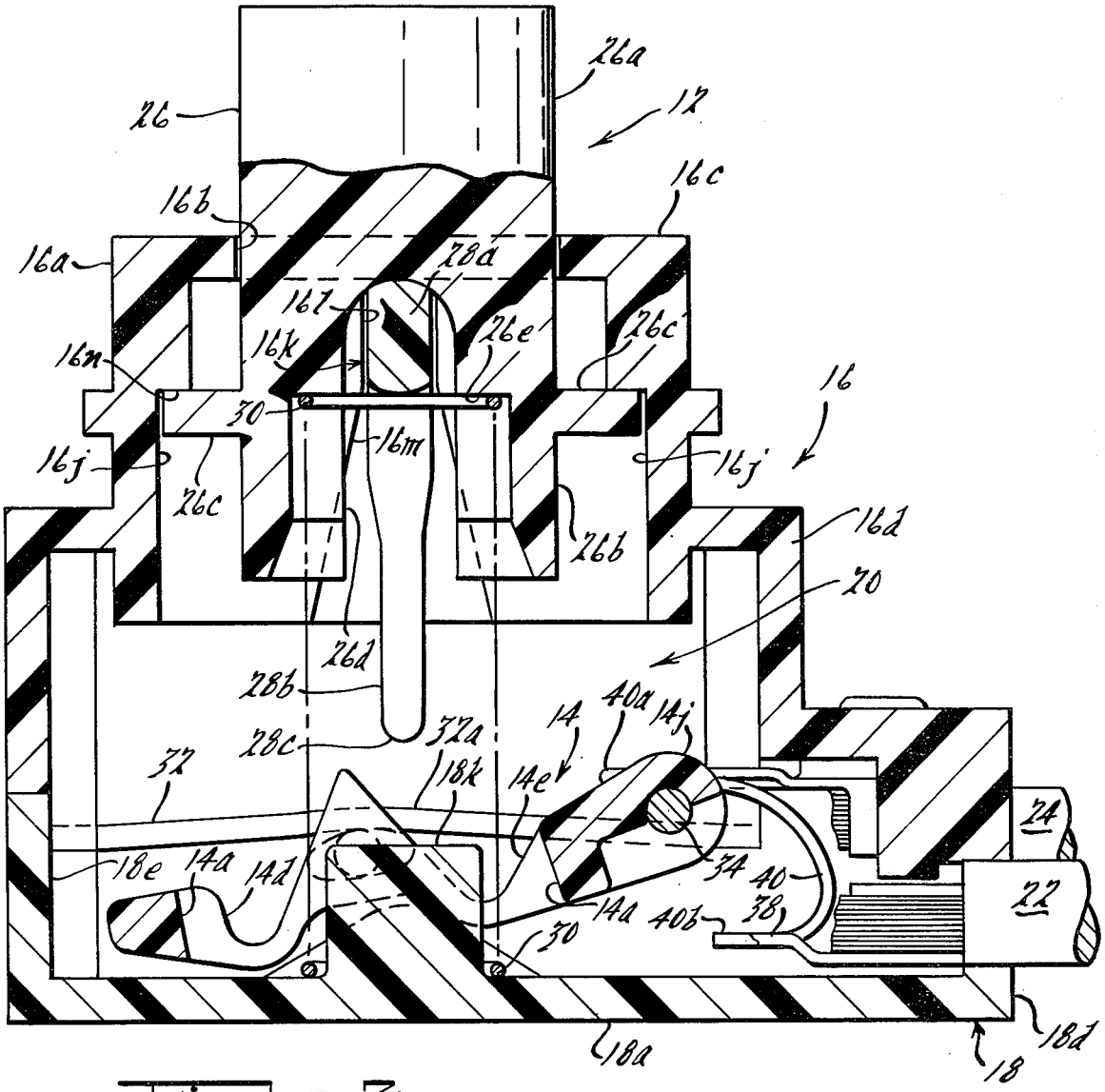
Figure 5:
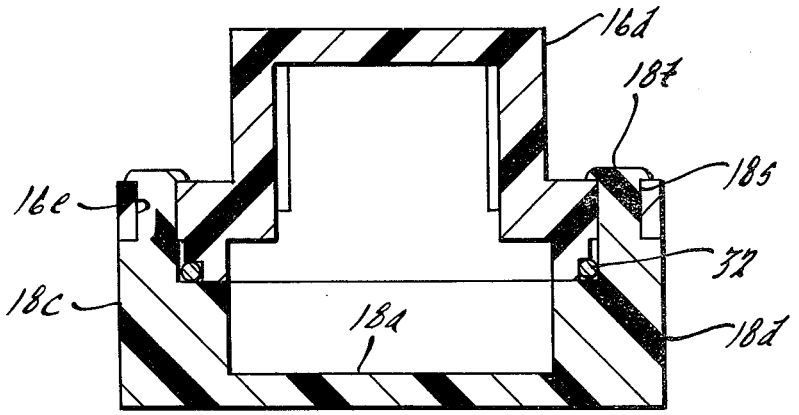
Figure 6:
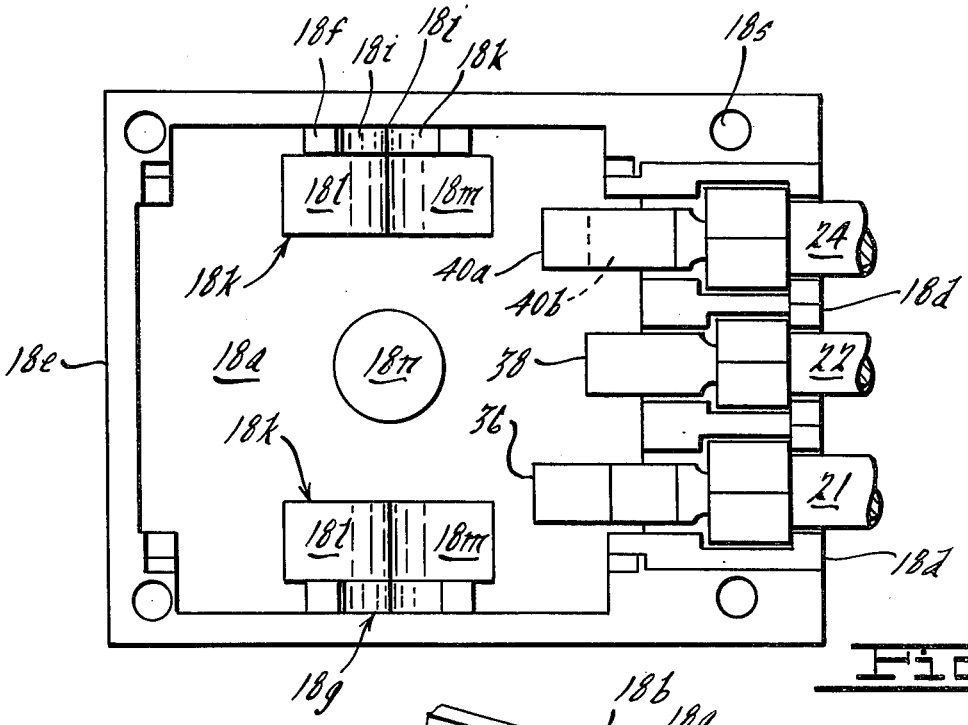
FIG. 6 is a top view of the lower switch housing.
Figure 7:
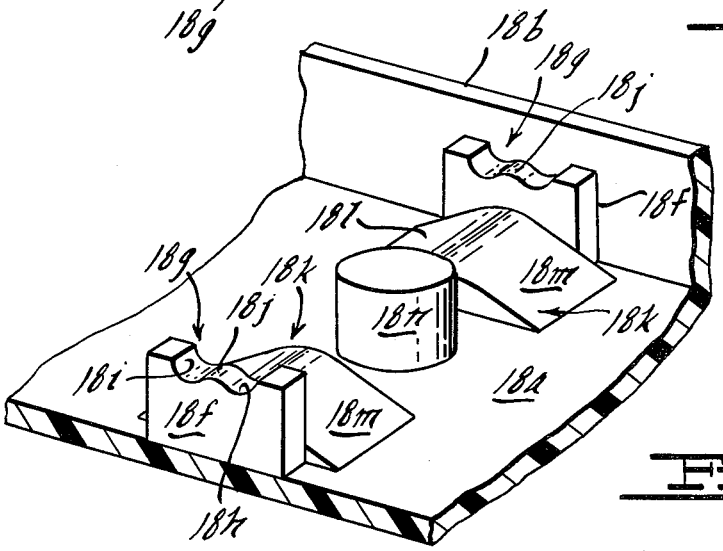
FIG. 7 is a fragmentary perspective view of a portion of the lower switch housing.
Figure 8:
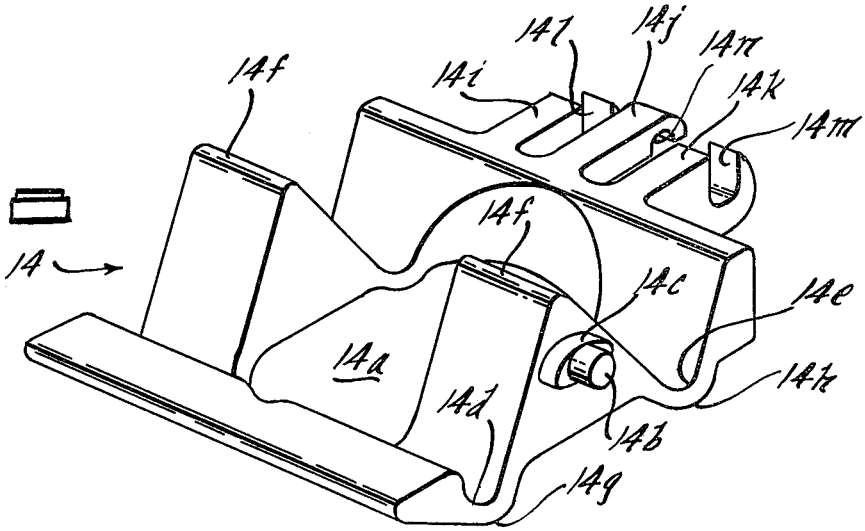
FIG. 8 is a perspective view of the rocker of the invention switch.
Figure 9:
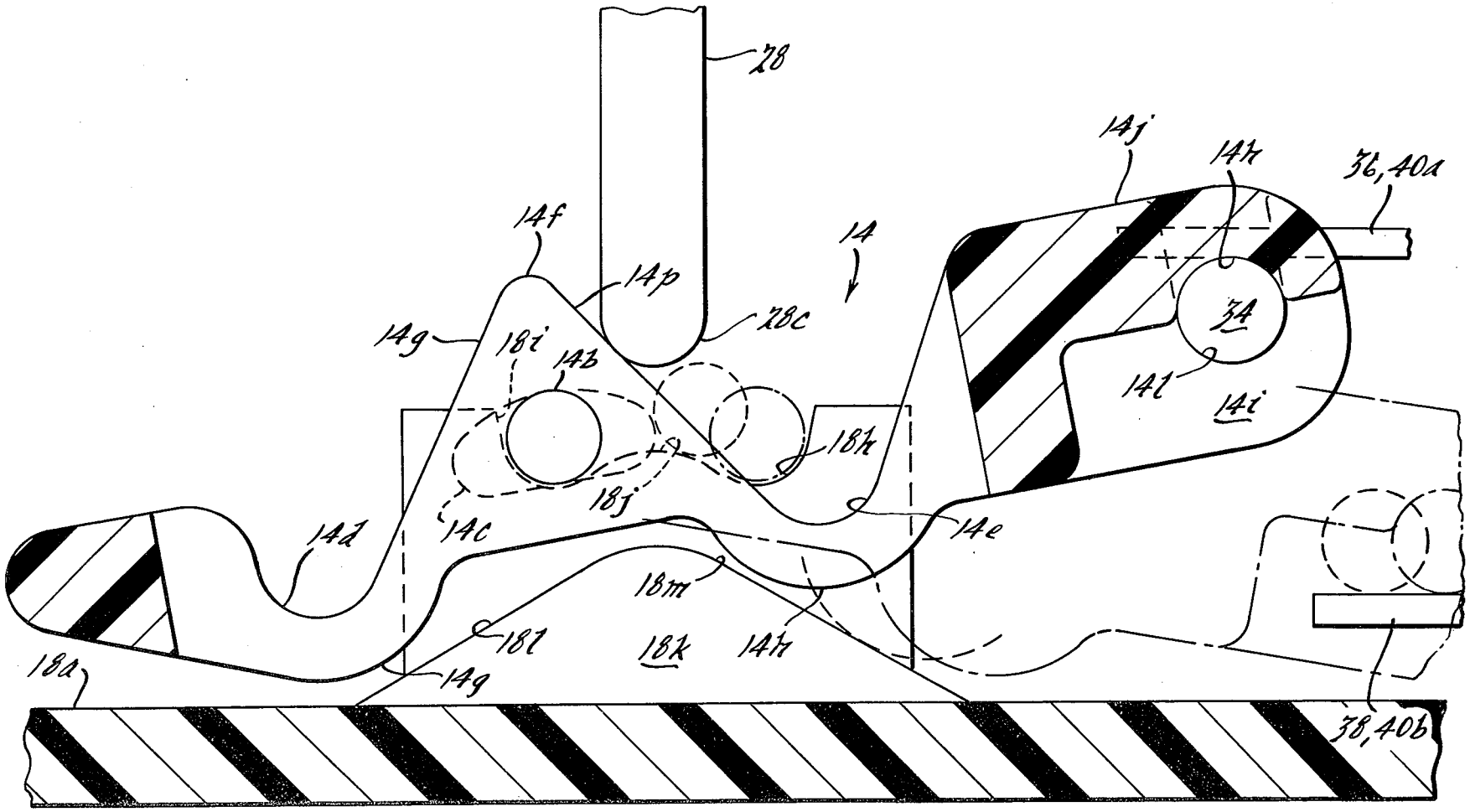
FIG. 9 is a diagrammatic view of the invention switch on an enlarged scale showing the basic switch operation.

The operation of the invention switch is best seen in FIG. 9. In the solid line position of FIG. 9, rocker 14 is seen in one of its two alternate switching positions in which contact pin 34 engages upper contacts or terminals 36, 40a to complete a circuit between wires 21 and 24. In this position, trunnions 14b are received in the rearward arcuate end portions 18i of bearing surfaces 18g and guide surfaces 14g, 14h are respectively spaced from underlying ramp surfaces 18l, 18m. When pushbutton 26 is depressed by an operator to perform a switching function, the leading edge 28c of plunger 28 moves downwardly from its rest position of FIG. 3 and strikes surface 14p of forward notch 14e. As the plunger continues downwardly, it moves into the bottom of notch 14e and transports rocker 14 to its other switching position, seen in fragmentary dash lines in FIG. 9, in which contact pin 34 engages lower contacts or terminals 38, 40b to complete a circuit between wires 22 and 24. The movement imparted to the rocker as it is transported between its solid line and chain line positions of FIG. 9 is a combined rotary and translational movement. Specifically, the initial striking engagement of the plunger with the rocker causes the rocker trunnions to rotate in bearing rear end arcuate portions 18i to rotate the rocker in a clockwise direction and quickly move contact pin 34 away from upper terminals 36, 40a. This pure rotary movement continues until rocker guide surface 14h engages underlying ramp surface 18m, at which time the continued transport of the rocker toward its chain line position is described by sliding movement of the trunnions out of arcuate portions 18i and along intermediate convex bearing surfaces 18j accompanied by sliding movement of guide surface 14h down ramp surface 18m. This movement, which includes substantial rotary and translational components, continues until contact pin 34 engages the upper surface of lower terminals 38, 40b. This intermediate position of the rocker is shown in dash lines in FIG. 9. The rocker thereafter lifts off of ramp surface 18m and further transport of the rocker is described by sliding movement of the trunnions downwardly along convex intermediate bearing portions 18j and into forward arcuate bearing seat portions 18h accompanied by sliding movement of contact pin 34 along lower terminals 38, 40b. This final rocker movement is substantially translatory and provides a wiping action between contact pin 34 and the lower terminals to minimize arcing and pitting. The spring loading of wires 32 is heightened by the upward movement of the trunnions out of arcuate seats 18i so that the wires unload as the trunnions begin their movement down convex bearing portions 18j to accelerate the movement of the trunnions into forward seats 18h and accelerate movement of the rocker into its lower switching position. The final movement of the rocker into its lower switching position is thus quick, positive and quiet.

The transport of the rocker from the lower chain line position to its upper solid line position is similar to its previously described transport from its upper to its lower position. Specifically, as plunger 28 is moved downwardly through another actuation stroke, leading edge 28c strikes surface 14q of rearward notch 14d. Trunnions 14b initially rotate in forward arcuate bearing seats 18*h* until guide surface 14*g* engages ramp surface 18*l*, whereafter the rocker slides down ramp 18*l* and the trunnions move upwardly out of forward seats 18*h* and along convex bearing surface 18*j* until contact pin 34 engages the underside of upper terminals 36, 40*a*, whereafter the rocker lifts off of ramp surface 18*l* and the contact pin slides along terminals 36, 40*a* while the trunnions are accelerated downwardly into rearward seats 18*i* by the unloading action of wire springs 32. In similar manner to the rocker transport from its upper to its lower position, the rocker transport from its lower to its upper position is characterized by rapid rotation of the contact bar away from the lower contacts to quickly and cleanly break that circuit, followed by a combined rotary and translatory movement of the rocker to bring the rocker contact into the vicinity of the upper contacts, followed by a quick, positive, substantially translatory movement of the rocker to its final position to provide a quick, positive wiping contact between the rocker contact and the upper contacts.

The invention switch will be seen to provide a high current carrying capacity by virtue of its quick break action and wiping make action. The invention switch also provides a quick, positive switching action without resort to failure prone snap action or toggle mechanisms. The invention switch also provides quiet switch operation without sacrificing positive switching performance. And the invention switch achieves all of these desirable features in a switch package that is simple and inexpensive to produce.

Although a preferred embodiment of the invention has been illustrated and described in detail, it will be apparent that various changes may be made in the preferred embodiment without departing from the scope or spirit of the invention.

I claim:

1. An electric switch comprising

A. a housing;

B. an actuator assembly comprising 1. a plunger mounted in said housing for reciprocal movement through successive actuation and return strokes and 2. spring means opposing movement of said plunger through an actuation stroke and operative to move said plunger through a return stroke upon removal of the actuating force at the conclusion of an actuating stroke;

C. a rocker mounted in said housing for successive transport between two alternate switching positions in responsive to successive striking engagement by a leading edge of said plunger as the latter moves through successive actuation strokes;

D. means operative to impart a combined rotary and translatory movement to said rocker as the latter is transported between its alternate switching position by said plunger;

E. trunnions on said rocker at opposite sides thereof; and

F. bearing surfaces on said housing receiving said trunnions;

G. said trunnions being rotatable on and slidable along said bearing surfaces as said rocker is transported between its alternate switching positions;

H. said bearing surfaces being curvilinear and each including arcuate concave seat portions at each end having a radius approximating that of said trunnions and an intermediate convex curvilinear portion smoothly interconnecting the inboard ends of the arcuate concave seat portions.

2. An electric switch according to claim 1 wherein

I. said operative means further includes intersecting ramp surfaces on said housing coacting with guide surfaces on said rocker to delimit the rotational movement of said rocker and assist in guiding it during its transport between alternate switching positions.

3. An electric switch according to claim 1 wherein

I. said switch further includes spring means urging said rocker trunnions into contact with said bearing surfaces and vectored to augment movement of the trunnions along the convex intermediate bearing portions and into an arcuate seat portion, whereby to accelerate movement of the rocker as it approaches a switching position.

4. An electric switch according to claim 1 wherein

I. said trunnions are provided adjacent the central portion of said rocker;

J. an electrical contact is provided adjacent one end of said rocker;

K. an electrical contact is provided in said housing for coaction with said rocker contact; and L. said rocker contact engages said housing contact as said rocker approaches a switching position and the rocker contact thereafter slides wipingly along the housing contact as the trunnions move along the convex intermediate bearing surface and into an arcuate concave seat portion.

5. An electric switch comprising

A. a housing;

B. an actuator assembly comprising 1. a plunger mounted in said housing for reciprocal movement through successive actuation and return strokes and 2. spring means opposing movement of said plunger through an actuation stroke and operative to move said plunger through a return stroke upon removal of the actuating force at the conclusion of an actuating stroke;

C. a rocker mounted in said housing for successive transport between two alternate switching positions in responsive to successive striking engagement by a leading edge of said plunger as the latter moves through successive actuation strokes;

D. means operative to impart a combined rotary and translatory movement to said rocker as the latter is transported between its alternate switching position by said plunger;

E. said rocker including 1. trunnions extending laterally from opposite sides of a central portion of the rocker, 2. a notch formed in the upper side of the rocker between said trunnions and each end of the rocker for successive striking receipt of the leading edge of said plunger as the latter moves through successive actuation strokes, and 3. a guide surface formed on the underside of the rocker between said trunnions and each end of the rocker;

F. said switch including an electrical contact carried at one end of said rocker and at least one electrical contact in said housing; and G. said housing including 1. curvilinear bearing surfaces receiving said trunnions and each including arcuate concave seat portions at each end having a radius approximating that of said trunnions and an intermediate convex curvilinear portion smoothly interconnecting the inboard ends of the arcuate concave seat portions and 2. intersecting ramp surfaces positioned beneath said rocker for respective sliding coaction with the rocker guide surfaces.

6. A switch according to claim 5 wherein the aforedescribed elements are dimensioned and configures such that the transport of the rocker from one switching position to the other is initially described by rotary moment of said trunnions in the respective bearing seat portions until one of said guide surfaces engages the respective ramp surface whereafter further transport of said rocker is described by sliding movement of said trunnions out of the bearing seat portions and along the intermediate convex bearing surfaces accompanied by sliding movement of said one guide surface on the respective ramp surface until said rocker contact engages said at least one housing contact whereafter said rocker lifts off of said ramp surface and further transport of said rocker is described by sliding movement of the trunnions along the convex intermediate bearing surfaces and into the other seat portions accompanied by sliding movement of said rocker contact along said housing contact.

7. A switch according to claim 5 wherein the aforedescribed elements are dimensioned and configured such that the transport of the rocker from one switching position to the other is described by sliding movement of said trunnions out of a seat portion of the bearing surfaces and along the intermediate convex bearing surfaces accompanied by sliding movement of one of said guide surfaces along a respective ramp surface until said rocker contact engages said at least one housing contact whereafter said rocker lifts off of said ramp surface and further transport is described by sliding movement of the trunnions along the convex intermediate bearing surfaces and into the other seat portions accompanied by sliding movement of said rocker contact along said housing contact.

8. An electric switch according to claim 7 and further including

H. spring means urging said rocker trunnions into contact with said bearing surfaces and vectored to augment movement of the trunnions along the convex intermediate portions and into an arcuate seat portion whereby to accelerate movement of the rocker as it approaches a switching position.

9. An electric switch according to claim 8 wherein said rocker spring means comprises a pair of wires of spring material mounted at their ends in said housing and having intermediate portions generally overlying said bearing surfaces and respectively bearing down on said rocker adjacent said trunnions to force the trunnions into contact with said bearing surfaces.

10. An electric switch comprising

A. a hollow housing defining a switching chamber;

B. said housing having curvilinear upwardly facing bearing surfaces at opposite sides of said chamber, each bearing surface including arcuate convex seat portions at each end thereof and an intermediate convex curvilinear portion smoothly interconnecting the inboard ends of the arcuate concave seat portions;

C. said housing having intersecting ramp surfaces in a lower portion of said chamber generally beneath said bearing surfaces;

D. a rocker mounted in said chamber for transport between alternate switching positions and including 1. trunnions, having a radius approximating that of the arcuate seat portions of said bearing surfaces, extending laterally from opposite sides of a central portion of the rocker and supported respectively on said bearing surfaces, 2. notches formed in the upper side of the rocker between said trunnions and the ends of the rocker, and 3. guide surfaces on the underside of the rocker between said trunnions and the ends of the rocker for respective sliding and guiding coaction with a respective ramp surface;

E. a pair of wires of spring material mounted at their ends in said housing and extending across said chamber with intermediate portions thereof generally overlying said bearing surfaces and respectively bearing down on said rocker adjacent said trunnions to urge the trunnions into contact with said bearing surfaces;

F. an electric contact carried at one end of said rocker;

G. an electric contact positioned in said chamber for switching coaction with said rocker contact as said rocker is transported between its alternate switching positions; and H. an actuator assembly comprising 1. a pushbutton mounted in a central upper portion of said housing for generally vertical reciprocal movement through actuation and return strokes and 2. a plunger pivotally engaged at its upper end with a lower portion of said pushbutton and defining a striking surface at a lower end arranged to strikingly enter first one and then the other rocker notch during successive actuation strokes of said actuator assembly to transport said rocker between its alternate switching positions with such transport being described by sliding movement of said trunnions out of a bearing surface seat portion and along the convex intermediate bearing portions accompanied by sliding movement of one of said guide surfaces on a respective ramp surface until the rocker contact engages the chamber contact whereafter the rocker lifts off of said ramp and further transport is described by sliding movement of the trunnions along the convex intermediate bearing portions and into the other seat portions accompanied by sliding movement of the rocker contact along the chamber contact.

11. An electric switch according to claim 10 wherein

I. there are two electric contacts positioned in said chamber;

J. said rocker contact engages a respective one of said chamber contacts in each switching position of said rocker; and K. said rocker lifts off of the respective ramp surface as the rocker contact engages each of said chamber contacts so that further movement of the rocker to its final switching position is described by sliding movement of the rocker contact along the respective chamber contact.

12. An electric switch according to claim 10 wherein

I. there are two single electric contacts and one double electric contact positioned in said chamber; and J. said rocker contact engages one of said single contacts and a lower portion of said double contact in one switching position and engages the other of said single contacts and an upper portion of said double contact in its alternate switching position.

* * * * *